US006158857A

United States Patent [19]

Elgee

[11] Patent Number: 6,158,857

[45] Date of Patent: Dec. 12, 2000

[54] INTERNAL DRUM COMMUNICATION USING A CAPACITOR

[75] Inventor: Steven B. Elgee, Portland, Oreg.

[73] Assignee: Hewlett-Packard Company, Palo Alto, Calif.

[21] Appl. No.: 09/302,177

[22] Filed: Apr. 29, 1999

[51] Int. Cl.[7] ..... B41J 2/01

[52] U.S. Cl. ..... 347/104; 400/568; 400/569; 310/68 R; 318/490; 178/4.1 A; 178/42

[58] Field of Search ..... 347/104; 310/68 R; 318/490, 817, 794; 400/279, 320, 144.3, 283, 568, 569; 178/4.1 A, 42

[56] References Cited

U.S. PATENT DOCUMENTS

| | | | |
|---|---|---|---|
| 3,589,494 | 6/1971 | Gloess | 400/144.3 |
| 3,784,983 | 1/1974 | Eckert, Jr. et al. | 714/809 |
| 3,824,597 | 7/1974 | Berg et al. | 370/215 |
| 3,915,280 | 10/1975 | Willcox | 400/320 |
| 4,605,887 | 8/1986 | Boella et al. | 400/568 |
| 4,630,949 | 12/1986 | Boella et al. | 400/569 |
| 4,930,087 | 5/1990 | Egawa et al. | 358/1.14 |
| 5,475,412 | 12/1995 | Wong | 347/104 |
| 5,731,826 | 3/1998 | Hirano | 347/19 |
| 5,940,097 | 8/1999 | Imai | 347/49 |

OTHER PUBLICATIONS

CAN Specification, Version 2.0, Robert Bosch GmbH, Postfach 50, D–700 Stuttgart 1, Germany 1991.

Motorola Semiconductor Application Note AN475, Single wire MI Bus controlling stepper motors, Michael Burri and Dr. Pascal Renard, Motorola Ltd. 1993.

Transmitting Data and Power over a One–Wire Bus, by Dan Awtrey, Sensors, Feb. 1997.

*Primary Examiner*—Eugene Eickholt

[57] ABSTRACT

An ink-jet printer for ink-jet printing onto a print media. The printer has an ink-jet cartridge for ejecting ink onto a print medium during printing operations. A rotating drum platen holds a print medium on an outer surface thereof, the drum platen having an interior volume defined therein and an end wall extending transversely to the outer surface. A carriage holds the cartridge in a closely arranged position relative to the external surface of the drum. A drum drive apparatus rotates the drum to move the print medium in relation to the printhead of the cartridge. The printer further has a printer controller mounted in a fixed position relative to a printer chassis, and an electronic circuit disposed in the interior volume of the drum platen. A data communication link passes data between the printer controller and the electronic circuit. The data link includes a capacitor comprising a first capacitor ring structure mounted to the end wall concentric to an axis of rotation of the platen, and a second capacitor ring structure mounted in fixed relation to the drum platen adjacent the end surface and in close proximity to the first capacitor ring structure.

11 Claims, 4 Drawing Sheets

INTERNAL DRUM COMMUNICATION USING A CAPACITOR

TECHNICAL FIELD OF THE INVENTION

The present invention relates to printers using a rotating drum platen, and more particularly to a technique to communicate with electronic circuitry inside the drum using a capacitive data link.

BACKGROUND OF THE INVENTION

Printers such as inkjet printers typically employ some type of platen to support the print medium during the printing process. One type of printer uses a rotating drum as the platen. The print medium, e.g. a sheet of paper, is secured to the periphery of the drum by a vacuum (or other attachment means, such as adhesive tape), and the drum rotated relative to a print cartridge carriage. The carriage holds one or more print cartridges, each having a printhead for ejecting droplets of ink in a controlled manner. The carriage is moved in two alternate ways as the drum is rotating. One way is to incrementally step or move the carriage from one swath to the next. The other is a continuous, very slow movement, so that the printhead moves in a spiral relative to the paper surface.

There can be a need to place an electronics package within the drum. This can be used for various purposes, e.g. to drive vacuum actuators, media clamps, drum temperature control for drum platen heaters, and drum temperature sensors. The printer will typically include a controller mounted in a fixed location relative to the printer chassis. However, the need to provide a communication link between the stationary controller and the electronics package located in a rotating drum presents problems. This invention provides a solution to these problems.

SUMMARY OF THE INVENTION

An ink-jet printer for ink-jet printing onto a print media is disclosed. The printer has an ink-jet cartridge for ejecting ink onto a print medium during printing operations. A rotating drum platen holds a print medium on an outer surface thereof, the drum platen having an interior volume defined therein and an end wall extending transversely to the outer surface. A carriage holds the cartridge in a closely arranged position relative to the external surface of the drum. A drum drive apparatus rotates the drum to move the print medium in relation to the printhead of the cartridge. The printer further has a printer controller mounted in a fixed position relative to a printer chassis, and an electronic circuit disposed in the interior volume of the drum platen. In accordance with the invention, the printer further includes a data communication link for passing data between the printer controller and the electronic circuit. The link includes a capacitor comprising a first capacitor ring structure mounted to the end wall concentric to an axis of rotation of the platen, and a second capacitor ring mounted in fixed relation to the drum platen adjacent the end surface and in close proximity to the first capacitor ring.

BRIEF DESCRIPTION OF THE DRAWING

These and other features and advantages of the present invention will become more apparent from the following detailed description of an exemplary embodiment thereof, as illustrated in the accompanying drawings, in which.

DETAILED DESCRIPTION OF THE PREFERRED EMBODIMENTS

Figure 1:
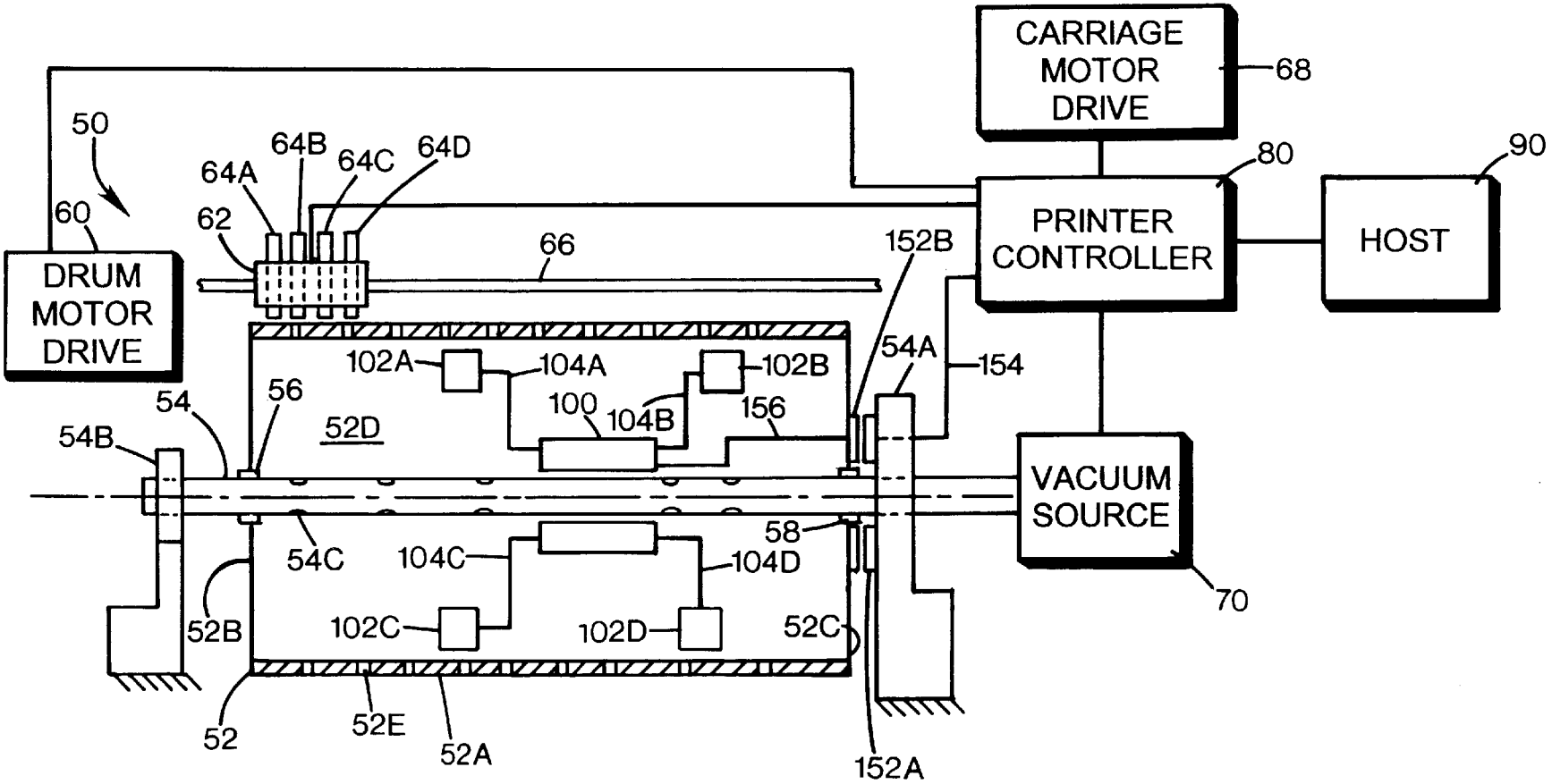
FIG. 1 is a simplified cutaway diagram illustrating a drum printer embodying this invention.

A drum printer 50 is diagrammatically illustrated in FIG. 1. The printer includes a rotatable hollow cylindrical drum platen 52 having an outer peripheral surface 52A to which a sheet of print media such as paper is secured for printing operations. The drum platen 52 is mounted for rotation about shaft 54 on bearings 56, 58 disposed adjacent opposite ends of the drum platen. The drum has end walls 52B, 52C enclosing the interior volume 52D of the drum platen. Orifices 52E are formed in the surface 52A.

In one exemplary embodiment, the shaft 54 is stationary, with the drum platen rotating about the shaft on bearings 56, 58. The shaft is secured on support brackets 54A, 54B which are affixed to the printer chassis. The shaft 54 is hollow with a series of openings 54C formed therein in a shaft region within the interior volume 52D. A source of vacuum 70 is connected to the interior space of the hollow shaft, and is thereby coupled to the interior volume 52D through the shaft openings 54C, drawing the ambient atmosphere through the orifices 52A when open or not blocked by the print medium. This serves to hold the print medium against the surface 52A of the drum platen during print operations.

A drum motor drive 60 is coupled to the drum platen 52, e.g. by a gear train or belt system comprising the drum motor drive. A pen carriage 62 holds a plurality of inkjet pens 64A–64D adjacent the peripheral surface of the drum platen, and is mounted on a carriage slide 66 for movement in a direction parallel to the longitudinal axis of the drum platen. The respective pens include nozzle arrays and eject ink of different colors to provide a color image. Of course, the invention is not limited to ink-jet printers, and has utility with many types of printers, image recording systems and the like.

A carriage motor drive 68 is coupled to the carriage, e.g. through a belt or other conventional techniques, to move the carriage along a range of motion. A printer controller 80 provides print firing pulses to the pens 64A–64D, and control signals to the carriage motor drive 68 and the drum motor drive 60. The print controller 80 receives print job data and commands from a host 90 such as a personal computer, or from other sources, such as a digital camera.

During print operations, the drum platen is rotated, and the pens are actuated to eject droplets of ink of different colors in a controlled fashion. The carriage can be moved in incremental steps, or continuously moved to provide a spiral path of the nozzle arrays in relation to the surface of the drum platen.

An electronic circuit 100 is located in the interior volume 52D of the drum platen, and can rotate with the drum platen during print operations. The circuit 100 can be affixed to one of the end walls 52B or 52C of the drum platen, or to mounting structure (not shown) within the interior volume 52D. The electronic circuit 100 can include a controller or logic circuitry, or in very simple applications, a shift register for holding the state of control bits used to control the state of a controlled element within the interior volume 52D. Electrical power can be supplied to the circuit 100 by a battery (not shown), by slip rings (not shown for dc power transfer), or by capacitive or inductive coupling. The circuit 100 can control or drive a plurality of actuators such as actuators 102A–102D through wire connections 104A–104D. The locations of the circuit 100 and actuators 102A–102D illustrated in FIG. 1 is illustrative but it will be understood that these elements can be positioned at various locations within the drum platen. The actuators can be used to selectively open or close respective orifices 52E in the surface 52A. This is useful when the print media does not cover the entire portion of the surface 52A over which the orifices are distributed, thereby reducing vacuum loss through uncovered orifices. Other electrical devices can be located in the volume 52D, as represented by one or more of the reference characters 102A–102D, such as a platen heater or a temperature sensor, and these can be connected to the circuit 100 as well.

Figure 2:
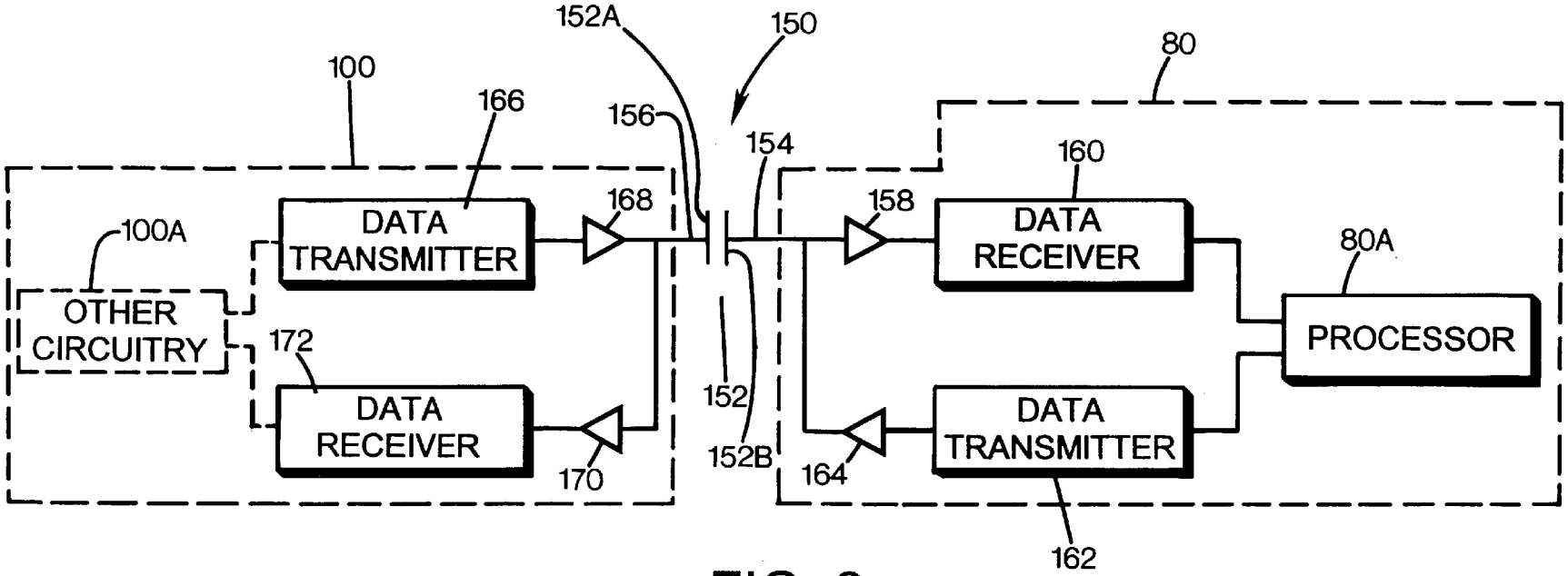
FIG. 2 is a schematic diagram of the communication link for the drum printer of FIG. 1 in accordance with this invention.

The problem arises as to how to provide an inexpensive yet reliable communication link between the circuit 100 with the rotating drum platen 52 and the print controller 80 located in a fixed location. This is needed to provide commands and data to be passed between the controller 80 and the circuit 100. This invention provides a solution to this problem. A capacitively-coupled data link 150 is provided, as illustrated in FIG. 2. A feature of the data link is capacitor 152 which comprises a pair of flat ring conductor elements 152A, 152B mounted in a close-facing relationship. The ring element 152A is mounted on bearing structure 58. The ring element 152B is mounted on end wall 52C. The diameter of the ring elements is sufficient that the rings do not interfere with the operation of the bearing 58. The ring 152A is electrically connected to the printer controller 80 via wiring 154. The ring 152B is electrically connected to the circuit 100 by wiring 156.

The flat ring conductor elements 152A, 152B are of course electrically isolated from printer grounding. In an exemplary embodiment, the end wall 52C and the support bracket 54A to which the ring conductor elements are affixed are each fabricated of an electrically non-conductor material, such as a plastic.

In an exemplary embodiment, the data link 150 further includes respective amplifier 158 and data receiver 160, for receiving data link signals from the circuit 100, and a data transmitter 162 and amplifier 164 for transmitting data link signals to the circuit 100. The elements 158–164 can comprise the printer controller 80 as illustrated, or comprise a separate data link circuit. The output of the data receiver 160 is connected to the processor 80A comprising the printer controller; the input of the data transmitter 162 is coupled to the processor 80A. Thus, the processor 80A receives the data from the circuit 100, and controls the data transmitted to the circuit 100. The processor 80A can be a microprocessor, ASIC or other type of electronic controller known in the art.

In a similar fashion, the data link 150 further includes data transmitter 162 and amplifier 168, receiving data from the circuit 100 to transmit to the printer controller 80, and amplifier 170 and data receiver 172 to receive data from the print controller 80. The input of the data transmitter 166 is connected to other circuitry generally shown as 100A comprising circuit 100, e.g. a controller. The output of the data receiver 172 is connected to the other circuitry. In one exemplary application, the other circuitry could comprise a shift register for holding a set of bits, wherein the bits are transmitted over the data and shifted into the shift register. The state of these bits can then control directly the state of respective ones of the actuators 102A–102D. In such a case, the data link 150 can be simplified to provide a one-way data link. Thus, for some applications, the data link could omit the data receiver 160 and the data transmitter 166, and provide only the capability of transmitting data from the controller 80 to the circuit 100. Alternatively, a one-way data link could be employed which has only the capability of transmitting data from the circuit 100 to the controller 80. In a more complex system, the other circuit 100A can comprise a microprocessor, ASIC or logic circuitry.

In an exemplary embodiment, the data link 150 employs a serial communications protocol for data transmission. One exemplary protocol suitable for the purpose is the Controller Area Network (CAR) protocol described for example in *Can Specification,* Version 2.0, Robert Bosch GmbH, Postfach 50, D-700 Stuttgart 1, Germany, 1991, the entire contents of which are incorporated herein by this reference. Other communications protocols could alternatively be employed, examples of which include the Motorola Interconnect Bus, a serial bus and communications protocol described in Motorola SEMICONDUCTOR Application Note AN475, "Single wire MI Bus controlling stepper motors," Michel Burri and Dr. Pascal Renard, Motorola LTD. 1993, and the MicroLan system described in "Transmitting Data and Power over a One-Wire Bus," Dan Awtrey, *Sensors,* February 1997.

The data transmitters 162, 166 generate a suitable waveform to transfer information through the capacitor 152, e.g. a square wave at some appropriate repetition frequency, e.g. 100 Khz. The transmitters provide sufficient drive that the waveform has square edges.

Figure 3:
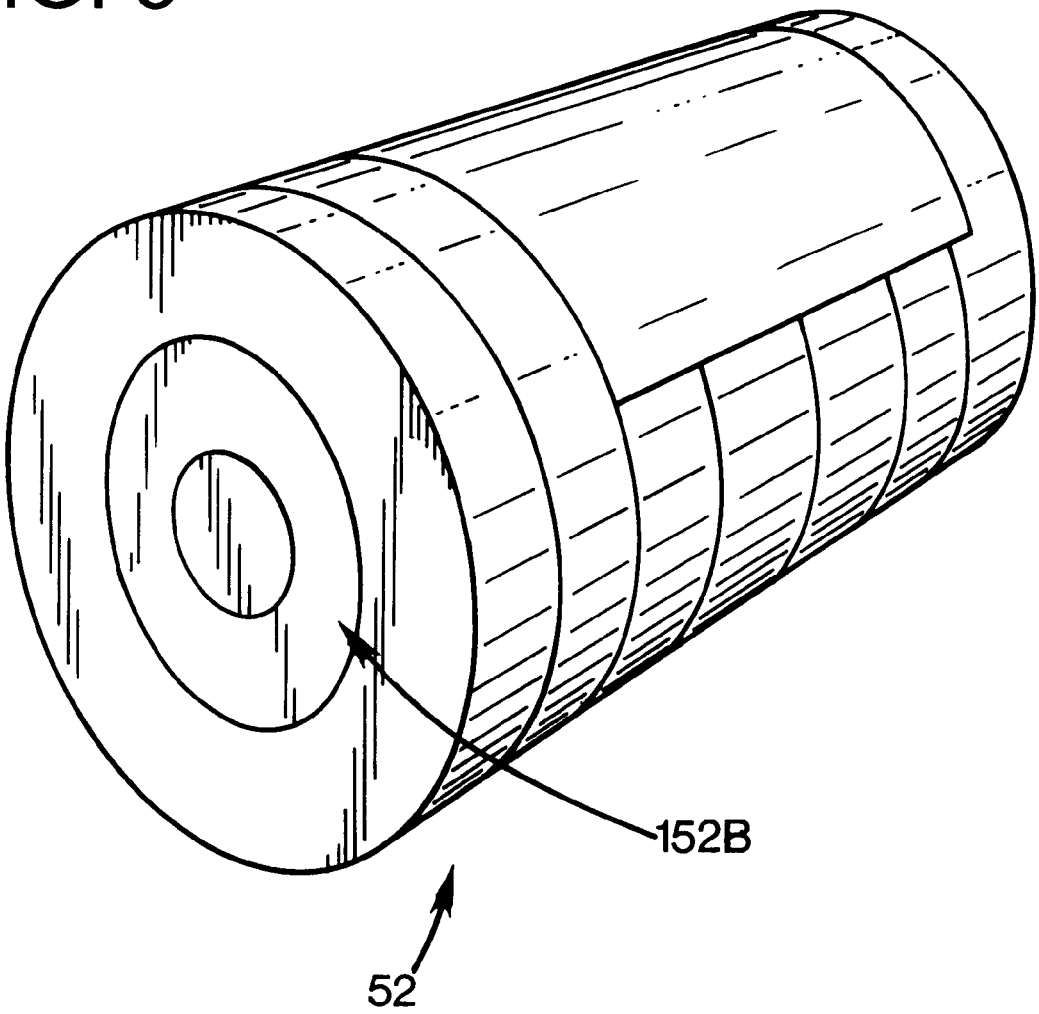
FIG. 3 is an isometric side view of the drum platen of the printer of FIG. 1, showing the capacitor ring.

FIG. 3 is an isometric side view of the drum platen 52, showing the capacitor ring 152B on the end wall surface 52C.

Figure 4:
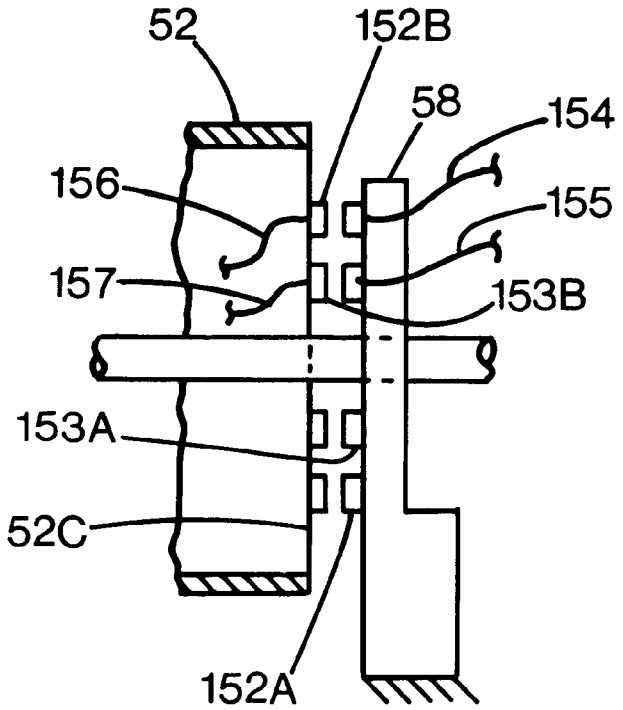
FIG. 4 is a cutaway partial side view of an alternate embodiment of the printer employing two sets of capacitive rings.
Figure 5:
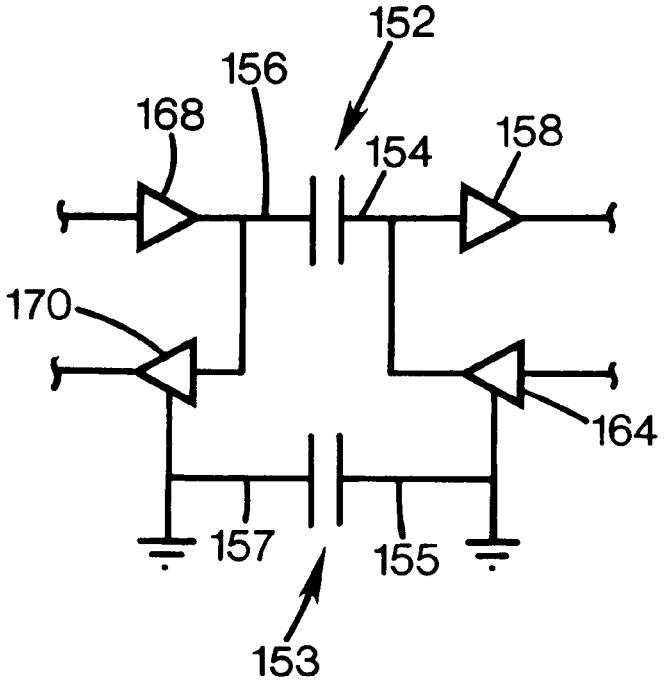
FIG. 5 is a schematic diagram of a portion of the communication link for the alternate drum printer of FIG. 4.

In the embodiment of FIGS. 1 and 2, a single set of capacitive rings is employed, to provide a single wire link, wherein the ground return for the data link circuit is provided through the chassis grounding of the printer, with the shaft providing a path to ground for the circuit 100. To provide a separate return path, two sets of concentric capacitive rings could be employed. This is illustrated in FIGS. 4 and 5, wherein a second capacitor 153 is added, comprising a conductive ring 153A supported on bearing structure 58, and a conductive ring 153B supported on the end wall 52C of the drum platen 52. Ring 153A is connected to the printer controller 80 ground terminal by wire 155, and ring 153B is connected to the ground terminal for the circuit 100 by wire 157. The capacitance of the two sets of rings is large in comparison to stray capacitances. It is not necessary for the circuit 100 to have the same ground potential as the ground potential for the controller 80.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A printer for printing onto a print media, comprising:

a rotating drum platen for holding a print medium on an outer surface thereof, the drum platen having an interior volume defined therein and an end wall extending transversely to the outer surface;

apparatus for rotating the drum to move the print medium during printing operations;

a printer controller mounted in a fixed position relative to a printer chassis;

an electronic circuit disposed in said interior volume of said drum platen; and a data communication link for passing data between the printer controller and the electronic circuit, the link comprising a capacitor comprising a first capacitive structure mounted to the end wall of the drum platen, and a second capacitive structure mounted in fixed relation to the drum platen adjacent the end surface and in close proximity to the first capacitive structure, wherein data is passed through said capacitor.

2. The printer of claim 1 wherein the data communication link further comprises a data transmitter mounted in a fixed position for generating a data communication waveform, the data transmitter electrically connected to the second capacitive structure, and a data receiver mounted within said interior volume and electrically connected to the first capacitive structure.

3. The printer of claim 2 wherein the data communication waveform comprises a square wave signal.

4. The printer of claim 1 wherein the data communications link is a bi-directional link, and includes a first data transmitter coupled to the printer controller and mounted in a fixed position for generating a data communication waveform, the first data transmitter electrically connected to the second capacitive structure, and a first data receiver mounted within said interior volume and electrically connected to the first capacitive structure to communicate data from the printer controller to the electronic circuit mounted in the interior volume, and a second data transmitter disposed in the interior volume and coupled to the electronic circuit and to the first capacitive structure, and a second data receiver mounted in a fixed position and electrically connected to the printer controller and to the second capacitive structure to communicate data from the electronic circuit to the printer controller.

5. The printer of claim 1 wherein said first capacitive structure comprises a first flat conductive ring surface on said end wall concentric to an axis of rotation of the drum platen, and said second capacitive structure comprises a second flat conductive ring surface fixedly mounted concentric to said axis of rotation of the drum platen.

6. The printer of claim 1 wherein the data link further comprises a second capacitor, said second capacitor including a third capacitive structure mounted to the end wall and a fourth capacitive structure mounted in fixed relation to the drum platen adjacent the end surface and in close proximity to the third capacitive structure.

7. An ink-jet printer for ink-jet printing onto a print media, comprising:

an ink-jet cartridge for ejecting ink onto a print medium during printing operations;

a rotating drum platen for holding a print medium on an outer surface thereof, the drum platen having an interior volume defined therein and an end wall extending transversely to the outer surface;

a carriage for holding said cartridge in a closely arranged position relative to a surface of said drum;

apparatus for rotating the drum to move the print medium in relation to the printhead of the cartridge;

a printer controller mounted in a fixed position relative to a printer chassis;

an electronic circuit disposed in said interior volume of said drum platen; and a data communication link for passing data between the printer controller and the electronic circuit, the link comprising a capacitor comprising a first capacitor ring structure mounted to the end wall concentric to an axis of rotation of the platen, and a second capacitor ring mounted in fixed relation to the drum platen adjacent the end surface and in close proximity to the first capacitor ring.

8. The printer of claim 7 wherein the data communication link further comprises a data transmitter mounted in a fixed position for generating a data communication waveform, the data transmitter electrically connected to the second capacitor ring, and a data receiver mounted within said interior volume and electrically connected to the first capacitor ring.

9. The printer of claim 8 wherein the data communication, waveform comprises a square wave signal.

10. The printer of claim 7 wherein the data communications link is a bi-directional link, and includes a first data transmitter coupled to the printer controller and mounted in a fixed position for generating a data communication waveform, the first data transmitter electrically connected to the second capacitive structure, and a first data receiver mounted within said interior volume and electrically connected to the first capacitive structure to communicate data from the printer controller to the electronic circuit mounted in the interior volume, and a second data transmitter disposed in the interior volume and coupled to the electronic circuit and to the first capacitive structure, and a second data receiver mounted in a fixed position and electrically connected to the printer controller and to the second capacitive structure to communicate data from the electronic circuit to the printer controller.

11. The printer of claim 7 further comprising a vacuum source coupled to the interior volume of the drum platen, the platen having a plurality of openings formed therein in a distributed arrangement over the outer surface, and further including at least one actuator device controlled by said electric circuit for selectively closing one of said openings to prevent loss of vacuum when the print media is not covering said one opening, and wherein said data communication link passes data between said controller and said electronic circuit to control said actuator.

* * * * *